US010329851B2

(12) United States Patent
Cull et al.

(10) Patent No.: US 10,329,851 B2
(45) Date of Patent: Jun. 25, 2019

(54) SUB FOR ACCOMMODATING LARGE DEVICES

(71) Applicant: Halliburton Energy Services, Inc, Houston, TX (US)

(72) Inventors: Robert J. Cull, Tewkesbury (GB); Stephen Daniel Lloyd, Upton Upon Severn (GB); David James Laban, Bisphop's Cleeve (GB)

(73) Assignee: Halliburton Energy Services, Inc., Houston, TX (US)

( * ) Notice: Subject to any disclaimer, the term of this patent is extended or adjusted under 35 U.S.C. 154(b) by 60 days.

(21) Appl. No.: 15/518,393

(22) PCT Filed: Dec. 11, 2014

(86) PCT No.: PCT/US2014/069818

§ 371 (c)(1),
(2) Date: Apr. 11, 2017

(87) PCT Pub. No.: WO2016/093844

PCT Pub. Date: Jun. 16, 2016

(65) Prior Publication Data

US 2017/0306709 A1 Oct. 26, 2017

(51) Int. Cl.
*E21B 17/18* (2006.01)
*E21B 21/12* (2006.01)
(Continued)

(52) U.S. Cl.
CPC ..... *E21B 17/18* (2013.01); *E21B 17/02* (2013.01); *E21B 17/1078* (2013.01);
(Continued)

(58) Field of Classification Search
CPC ..... E21B 17/1078; E21B 17/18; E21B 21/12; E21B 17/16
See application file for complete search history.

(56) References Cited

U.S. PATENT DOCUMENTS 3,712,392 A 1/1973 Gorgendiere
3,945,446 A 3/1976 Ostertag et al.
(Continued)

FOREIGN PATENT DOCUMENTS

WO WO 2011/072367 A1 6/2011
WO WO 2012/074834 A2 6/2012

OTHER PUBLICATIONS

International Search Report and The Written Opinion of the International Search Authority, or the Declaration, dated Aug. 19, 2015, PCT/US2014/069818, 19 pages, ISA/KR.
(Continued)

*Primary Examiner* — Cathleen R Hutchins
(74) *Attorney, Agent, or Firm* — Haynes and Boone, LLP

(57) ABSTRACT

A sub, downhole tool, and method for manufacturing thereof, are disclosed. The sub may include one or more flow channels, each of which may be defined in part by a longitudinal groove formed along an exterior of a collar. One or more flow channel cover may be connected to the collar. The longitudinal grooves position the flow channels further outward to provide more volume within the collar that may be used for housing one or more devices. Upper and lower blind bores are fluidly coupled to the longitudinal grooves by angled through bores to complete the flow channels. A medial bore, which may be fluidly isolated from the flow channels, may be provided to house a device, such as an instrument, detector, or circuitry.

26 Claims, 10 Drawing Sheets

(51) Int. Cl.

| | |
|---|---|
| ***E21B 47/01*** | (2012.01) |
| ***E21B 17/02*** | (2006.01) |
| ***E21B 17/10*** | (2006.01) |
| ***E21B 17/16*** | (2006.01) |

(52) U.S. Cl.

CPC ..... *E21B 17/16* (2013.01); *E21B 21/12* (2013.01); *E21B 47/01* (2013.01)

(56) References Cited

U.S. PATENT DOCUMENTS

| | | | | |
|---|---|---|---|---|
| 4,431,069 | A | 2/1984 | Dickinson, III et al. | |
| 4,615,399 | A | 10/1986 | Schoeffler | |
| 5,045,692 | A | 9/1991 | Arnold | |
| 5,216,242 | A | 6/1993 | Perry et al. | |
| 5,443,124 | A | 8/1995 | Wood et al. | |
| 7,152,700 | B2 | 12/2006 | Church et al. | |
| 7,493,949 | B2 | 2/2009 | Baird | |
| 7,559,362 | B2 | 7/2009 | Miner | |
| 8,496,460 | B2 | 7/2013 | Sutton | |
| 2004/0188143 | A1* | 9/2004 | Hughes | E21B 17/18 175/57 |
| 2005/0028973 | A1 | 2/2005 | Paluch et al. | |
| 2008/0164062 | A1 | 7/2008 | Brackin et al. | |
| 2009/0223671 | A1* | 9/2009 | Edwards | E21B 17/01 166/344 |
| 2012/0096935 | A1 | 4/2012 | Finke et al. | |
| 2013/0025865 | A1 | 1/2013 | Knobloch, Jr. et al. | |
| 2013/0168154 | A1 | 7/2013 | Webb | |
| 2013/0306319 | A1 | 11/2013 | Kolle | |

OTHER PUBLICATIONS

Patten, et al., "Methods of Flow Measurement in Well Bores," *Geological Survey Water-Supply Paper 1544-C, Pennsylvania Geological Survey, Department of Internal Affairs, Commonwealth of Pennsylvania*, 1962.

* cited by examiner

SUB FOR ACCOMMODATING LARGE DEVICES

PRIORITY

The present application is a U.S. National Stage patent application of International Patent Application No. PCT/US2014/069818, filed on Dec. 11, 2014, the benefit of which is claimed and the disclosure of which is incorporated herein by reference in its entirety.

TECHNICAL FIELD

The present disclosure relates generally to oilfield equipment, and in particular to downhole tools, drilling and related systems and techniques for drilling, completing, servicing, and evaluating wellbores in the earth.

BACKGROUND

During the drilling, completion, servicing, or evaluation of an oil or gas wellbore or the like, situations are encountered it which it may be desirable to provide measurement data or perform other operations. A logging tool, which may have one or more devices, which may include instruments, detectors, circuits, and the like, may be carried along a drill string or a bottom hole assembly and lowered into a wellbore for taking and communicating measurements at various wellbore depths and/or performing other functions.

For example, measurements may be taken in real time during drilling operations. Such techniques may be referred to as measurement while drilling ("MWD") or logging while drilling ("LWD"). Measurement data and other information may be communicated through fluid within the drill string or annulus using various telemetry techniques and converted to electrical signals at the surface.

MWD or LWD tools must also generally provide drilling fluid flow paths to support drilling operations. Because of inherent size restrictions, MWD or LWD tools may have limited cross-sectional area to provide optimal drilling fluid flow while accommodating larger devices.

BRIEF DESCRIPTION OF THE DRAWINGS

Embodiments are described in detail hereinafter with reference to the accompanying figures, in which.

DETAILED DESCRIPTION

Figure 1:
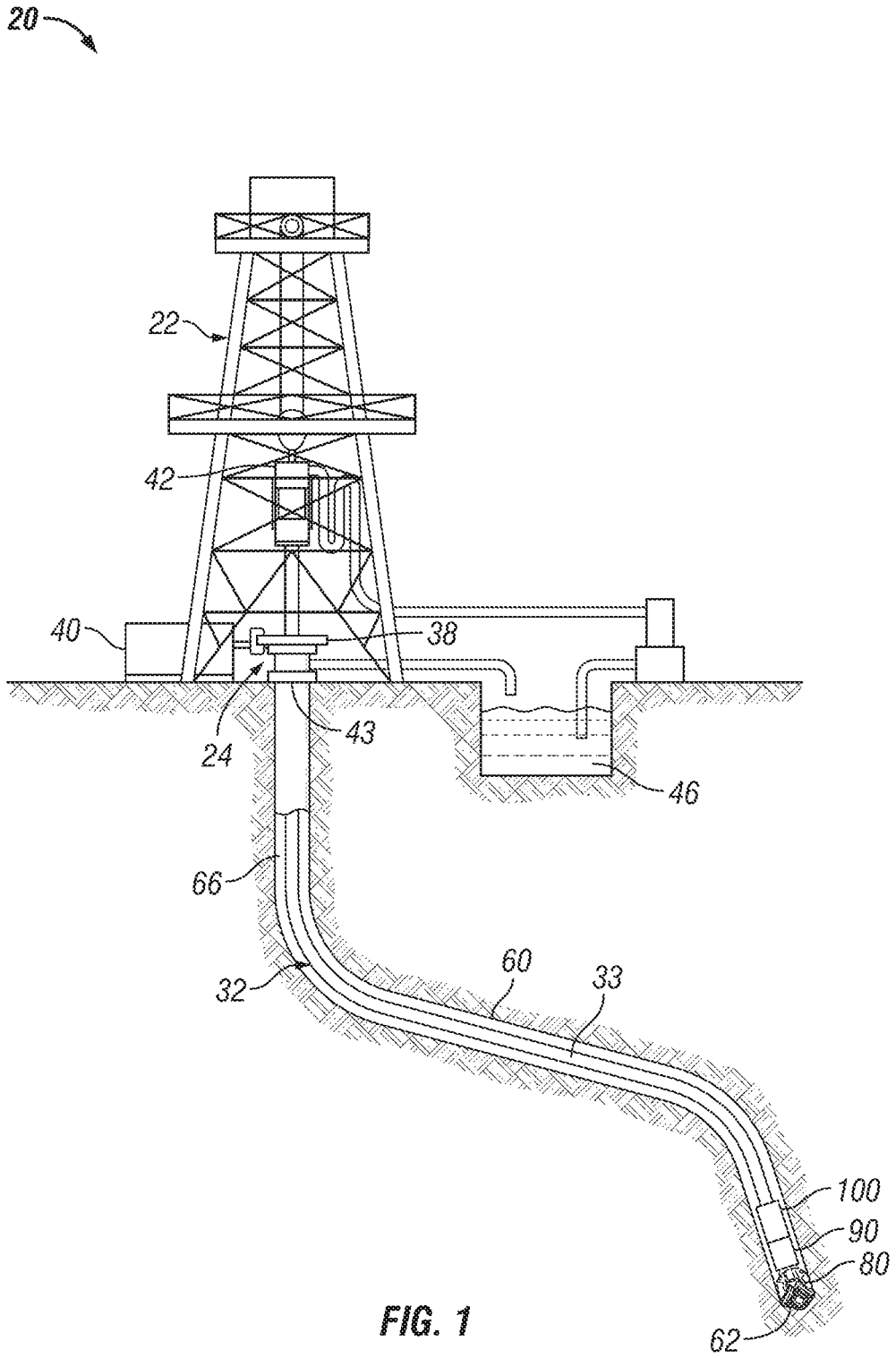
FIG. 1 is an elevation view in partial cross section of a drilling system that employs a drill string with drill pipe, and a sub according to an embodiment.

The present disclosure may repeat reference numerals and/or letters in the various examples. This repetition is for the purpose of simplicity and clarity and does not in itself dictate a relationship between the various embodiments and/or configurations discussed. Further, spatially relative terms, such as "beneath," "below," "lower," "above," "upper," "uphole," "downhole," "upstream," "downstream," and the like, may be used herein for ease of description to describe one element or feature's relationship to another element(s) or feature(s) as illustrated in the figures. The spatially relative terms are intended to encompass different orientations of the apparatus in use or operation in addition to the orientation depicted in the figures.

FIG. 1 is an elevation view in partial cross-section of a drilling system 20 which may include a bottom hole assembly 90 according to an embodiment. Drilling system 20 may include a drilling rig 22, such as the land drilling rig shown in FIG. 1. However, drilling system 20 may be deployed on offshore platforms, semi-submersibles, drill ships, and the like.

Drilling rig 22 may be located proximate to or spaced apart from well head 24, such as in the case of an offshore arrangement. Drilling rig 22 may include rotary table 38, rotary drive motor 40, and other equipment associated with rotation and translation of drill string 32 within wellbore 60. Annulus 66 is formed between the exterior of drill string 32 and the inside wall of wellbore 60. For some applications, drilling rig 22 may also include a top drive unit 42. Pressure control devices 43, such as blowout preventers and other equipment associated with drilling a wellbore may also be provided at well head 24.

The lower end of drill string 32 may include bottom hole assembly 90, which may carry at a distal end a rotary drill bit 80. Drilling fluid 46 may be pumped to the upper end of drill string 32 and flow through the longitudinal interior 33 of drill string 32, through bottom hole assembly 90, and exit from nozzles formed in rotary drill bit 80. At bottom end 62 of wellbore 60, drilling fluid 46 may mix with formation cuttings and other downhole fluids and debris. The drilling fluid mixture may then flow upwardly through annulus 66 to return formation cuttings and other downhole debris to the surface.

Bottom hole assembly 90 may include a downhole mud motor. Bottom hole assembly 90 and/or drill string 32 may also include various other tools that provide information about wellbore 13, such as logging or measurement data from the bottom 62 of wellbore 60. Measurement data and other information may be communicated using measurement while drilling techniques using electrical signals or other telemetry that can be converted to electrical signals at the well surface to, among other things, monitor the performance of drilling string 32, bottom hole assembly 90, and associated rotary drill bit 80.

In particular, devices, including MWD, LWD instruments, detectors, circuits, or other tools may be provided within a sub 100, according to one or more embodiments described in greater detail below. Sub 100 may be located as part of bottom hole assembly 90 or elsewhere along drill string 32. Moreover, multiple subs 100 may be provided. Although described in conjunction with drilling system 20, sub 100 may be used in any appropriate system and carried along any type of string. Sub 100 may be used to house an instrument, tool, detector, circuitry, or any other suitable device.

Figure 2:
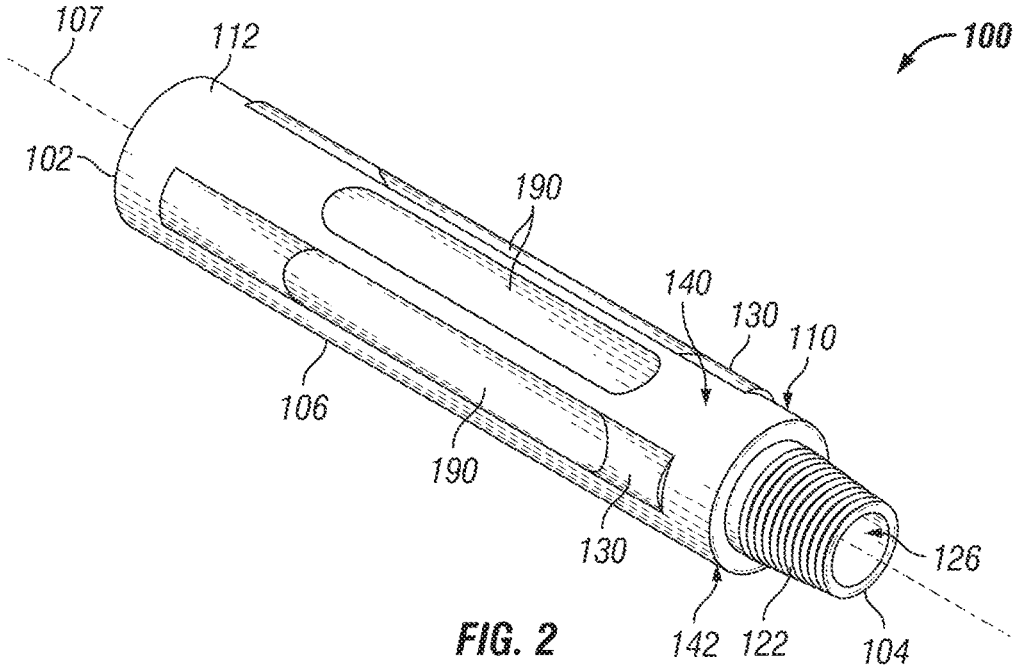
FIG. 2 is a perspective view of a sub having a collar with longitudinal grooves, covered by individual strip-shaped flow channel covers according to an embodiment, which may be used in the drilling system of FIG. 1 and which is shown oriented to reveal a lower end and the flow channel side of the collar.
Figure 3:
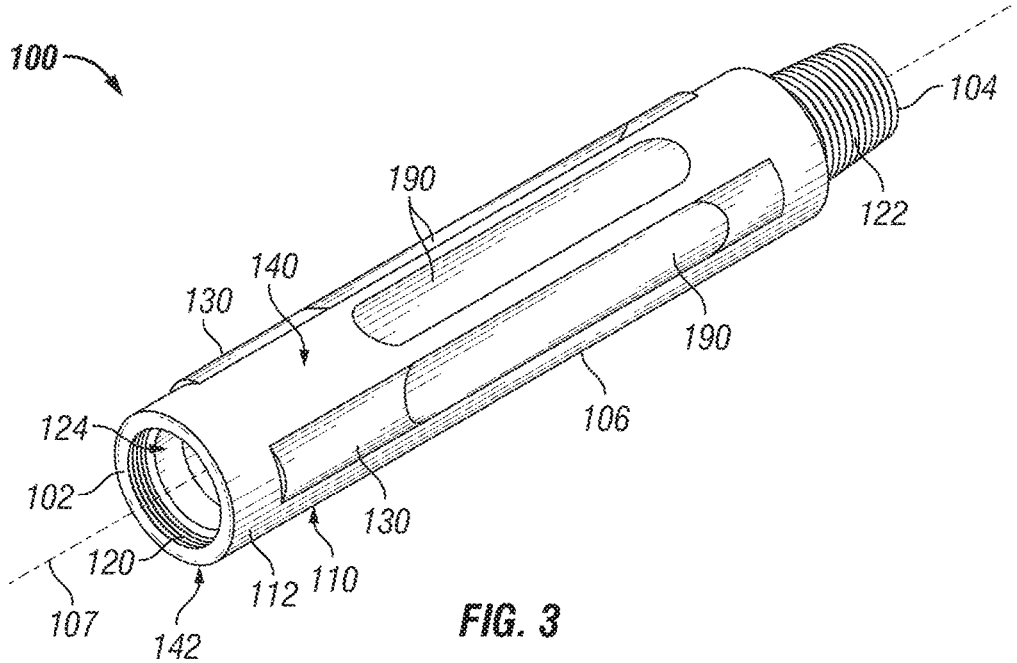
FIG. 3 is a perspective view of the sub of FIG. 2, with an upper end and the flow channel side of the collar being visible.

FIGS. 2 and 3 are perspective views of sub 100 according to an embodiment. Sub 100 may include a collar 110, having a generally cylindrical body 106 of outer diameter 112 and defining an upper end 102 and a lower end 104. The centerline of collar 110 may define a longitudinal sub axis 107. Collar 110 may be unitary, machined from a single bar for example. As used herein, a multi-faceted collar, for example, having a hexagonal or octagonal cross section, is generally cylindrical.

Upper end 102 of collar 110 may include an upper blind bore 124 (FIG. 3) formed therein, which may be but need not necessarily be centered about sub axis 107. Similarly, lower end 126 (FIG. 2) of collar 110 may include a lower blind bore 126 formed therein, which may also be but need not necessarily be centered about sub axis 107. As used herein, a blind bore refers to hole that is reamed, drilled, milled or otherwise formed to a specified depth without breaking through to the other side of the work piece, i.e., collar 110.

Upper and lower ends 102, 104 may have upper and lower connectors 120, 122, respectively. In an embodiment, upper and lower connectors 120, 122 may be integrally formed as part of collar 110. Connectors 120, 122 may be threaded pin and/or box connectors, for example. However pin/pin or box/box combinations, or other types of connectors may be used as appropriate. Connectors 120, 122 may allow sub 100 to be assembled as part of drill string 32 or bottom hole assembly 90 (FIG. 1), for example.

Body 106 of collar 110 may include a number of longitudinal stabilizer protrusions 130 extending beyond outer diameter 112. In the embodiment of FIGS. 2 and 3, three stabilizer protrusions 130 are provided (only two are visible) at 120 degree angular positions. However, four or more stabilizer protrusions 130 may be provided and spaced about collar body 106. Stabilizer protrusions 130 may function to keep sub 100 centered within wellbore 60 (FIG. 1). In an embodiment, stabilizer protrusions 130 may be integrally formed as part of collar 110. More specifically, collar 110, with stabilizer protrusions 130, may be machined from a cylindrical bar, by milling or otherwise cutting away the regions between and at the ends of stabilizer protrusions 130 to form outer diameter 112 of collar 110. Stabilizer protrusions may be straight, as illustrated, or they may spiral around outer diameter 112.

Figure 4:
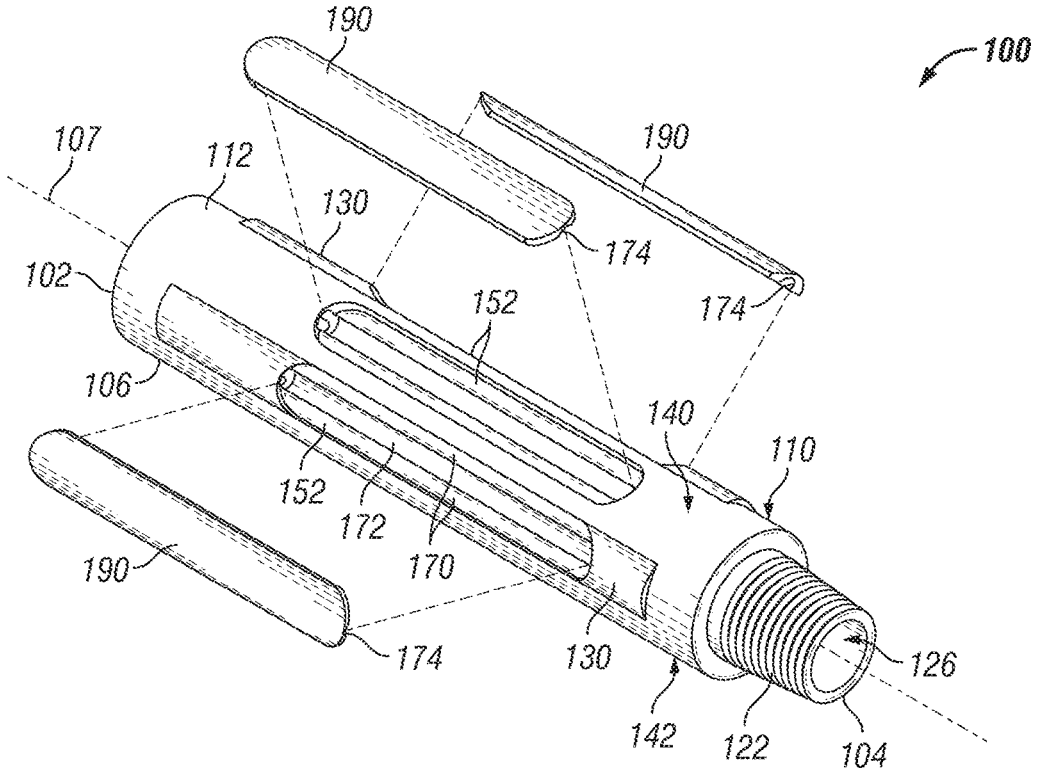
FIG. 4 is an exploded perspective view of the sub of FIG. 2, showing longitudinal grooves forming flow channels along the flow channel side of the collar and covers for separating the flow channels from the exterior.

FIG. 4 is an exploded perspective view of sub 100 according to the embodiment of FIGS. 2 and 3. Referring to FIGS. 2-4, body 106 of collar 110 may generally be considered to define two sides—a flow channel side 140 and a housing side 142. Flow channel side 140 is visible in FIGS. 2-4. Flow channel side 140 may include one or more flow channels 150 (FIGS. 6 and 7), each of which may be defined in part by a longitudinal groove 152 formed along an exterior of collar 110 and a flow channel cover 190 connected to collar 110. Flow channel 110 may form a seal with collar 110. In an embodiment, as illustrated, flow channel cover 190 may generally have the shape of a strip. One or more longitudinal grooves 152 may be formed along one or more stabilizer protrusions 130, thereby positioning flow channels 150 further outward with the advantage of providing more volume within collar 110 that may be used for housing one or more instruments, tools, detectors, circuits, and/or other suitable devices. One or more longitudinal grooves 152 may also be formed along the outer diameter 112 of collar 110, between stabilizer protrusions 130 if provided. Although not expressly illustrated, longitudinal grooves 152 need not be straight. For example, longitudinal grooves 152 may be spiral or helical grooves.

Figure 5:
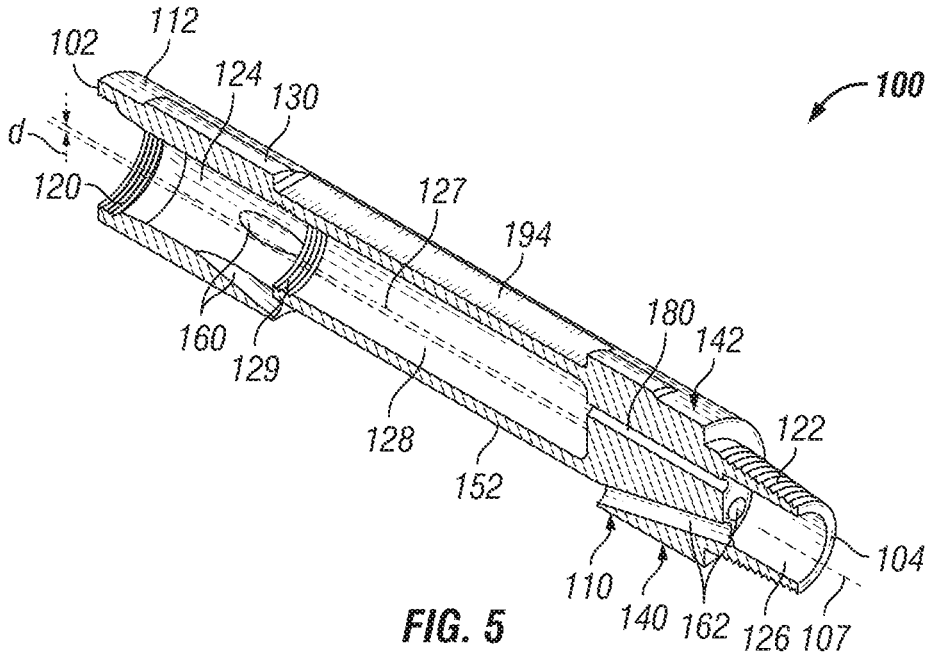
FIG. 5 is a perspective view in axial cross section of the collar of FIG. 4, oriented 180 degrees about its longitudinal axis to show a housing side of the collar, showing upper, lower, and medial bores and upper and lower angled bores formed therein.
Figure 6:
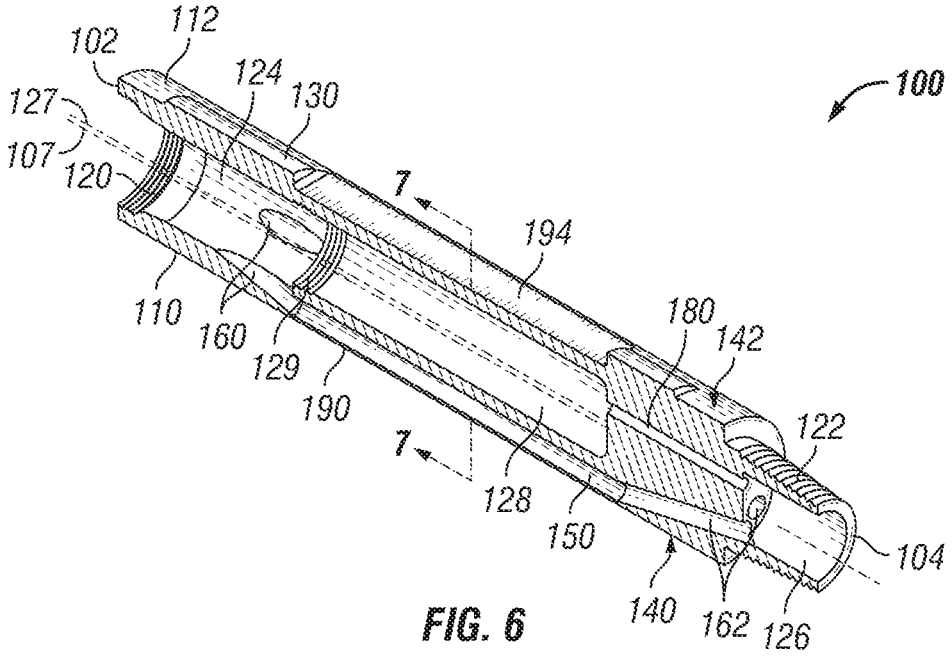
FIG. 6 is a perspective view in axial cross section of the sub of FIG. 4, oriented 180 degrees about its longitudinal axis to show the housing side of the collar, showing a flow channel cover disposed over a longitudinal groove.
Figure 7:
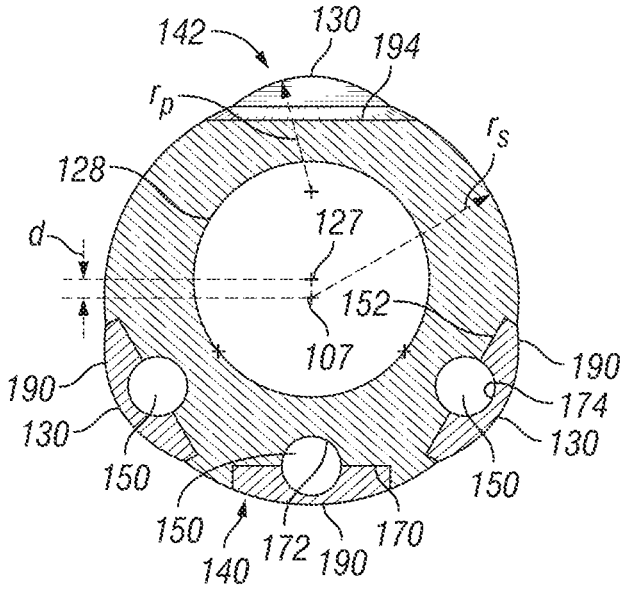
FIG. 7 is a transverse cross section taken along line 7-7 of FIG. 6, showing a medial bore, three flow channels, and a detector flat.

FIGS. 5 and 6 are axial cross sections of collar 110, shown without and with flow channel covers 190 installed, respectively. FIG. 7 is a transverse cross section of sub 100 taken along line 7-7 of FIG. 6. As compared to FIG. 2-4, collar 110 is shown in FIGS. 5-7 rotated 180 degrees about sub axis 107 to reveal housing side 142. Collar 110 may include upper and lower blind bores 124, 126 formed at upper and lower ends 102, 104, respectively. Upper and lower blind bores 124, 126 may be formed centered at sub axis 107.

A medial bore 128 may be formed within collar 110, opening into upper blind bore 124 or lower blind bore 126. Medial bore 128 may be a blind bore (illustrated in FIGS. 5 and 6), or it may be a through bore that is formed through collar 110 opening between upper and lower blind bores 124, 126 (see FIG. 9 hereinafter).

In an embodiment, medial bore 128 may, but need not necessarily, be formed on a centerline 127 that is offset from sub axis 107 a distance d towards housing side 142. An instrument, tool, detector, circuit and/or other device (not illustrated) may be loaded into sub 100 through upper blind bore 124, into medial bore 128, and sealed to avoid effects of hydrostatic pressure. Tapered female threads 129 may optionally be provided within medial bore 128 for receiving a threaded plug (not illustrated) to seal medial bore 128. However, other sealing methods, such as O-rings or potting, may be used as appropriate.

Referring now to FIGS. 4-7, flow channels 150 may be formed within sub 100 so as to bypass medial bore 128 by diverting drilling fluid flow to the circumferential extremities of flow channel side 140 while maintaining adequate flow area, thereby facilitating the positioning of medial bore 128 toward housing side 142 of sub 100 and maximizing the available diameter of medial bore 128. In an embodiment, one or more flow channels 150 are defined in part by longitudinal grooves 152 formed along the exterior of collar 110. Three such flow channels 150 are illustrated, but any suitable number of flow channels 150 may be provided.

An upper angled through bore 160 may be formed between the upper end of each longitudinal groove 152 and upper blind bore 124. Similarly, a lower angled through bore 162 may be formed between the lower end of each longitudinal groove 152 and lower blind bore 126, thereby fluidly coupling upper blind bore 124 with lower blind bore 126. As used herein, a through bore refers to hole that is reamed, drilled, milled or otherwise formed so as to break through at least a portion of the work piece. Any suitable angle for upper and lower through bores may be used, up to and including 90 degrees with respect to sub axis 107.

Referring to FIGS. 5-7, a conduit 180 may be formed through collar 110 from a blind end of medial bore 128 to the blind end of lower blind bore 126. Conduit 180 may allow for communication from a device housed within medial bore 128 to a device mounted below sub 100. Conduit 180 may be stuffed, packed, or a gland seal may be provided (not illustrated), to maintain fluid-tight integrity of medial bore 128. A similar arrangement (not illustrated) may be provided at the upper end of medial bore 128 for communication to a device mounted above sub 100.

In an embodiment, a flat 194 may optionally be formed on housing side 142 of body 106. Flat 194 may reduce adverse shielding effects of collar 110 on a gamma ray detector housed within medial bore 128. Thus, increased gamma detection rates may be provided by maximizing the size of a gamma detector housed within sub 100, by positioning medial bore 128 closer to housing side 142 of collar 110, and by providing flat 194 to reduce adverse shielding.

As illustrated in FIGS. 4 and 7, each longitudinal groove 152 may be a compound groove, which may include a wider and shallower seating surface 170 and a narrower and deeper trough 172. Seating surface 170 may be flat, and trough 172 may be arcuate, although other profiles may be used as appropriate. Seating surface 170 may provide a receptacle into which a strip-shaped flow channel cover 190 may be positioned and affixed to collar 110. Trough 172 may provide at least a portion of flow channel 150. Additionally, the inner side of flow channel cover 190 may include a trough 174 which may also form at least a portion of flow channel 150.

Each flow channel cover 190 may be attached to collar 110 within seating surface 170, thereby completing flow channels 150 and preventing fluid flow from exiting sub 100 at longitudinal grooves 152. Although not expressly illustrated, flow channel cover 190 may be attached using fasteners, such as bolts. A gasket may be provided between flow channel cover 190 and seating surface 170 to effect a seal. However, a complete seal may not be required. Flow channel cover 190 may also be both attached to and sealed against collar 110 by welding or brazing, for example. Other suitable attachment and sealing methods may also be used.

Referring now to FIG. 7, stabilizer protrusions 130 may be rounded and be characterized by radii $r_p$ that are smaller than the radius $r_c$ of outer diameter 112 of collar 110. Flow channel cover 190 may similarly have an outer radius $r_p$ for covering a longitudinal groove 152 formed along a stabilizer protrusion 130 or an outer radius $r_c$ for covering a longitudinal groove 152 formed along outer diameter 112 of collar 110 between stabilizer protrusions 130, if provided.

Figure 8:
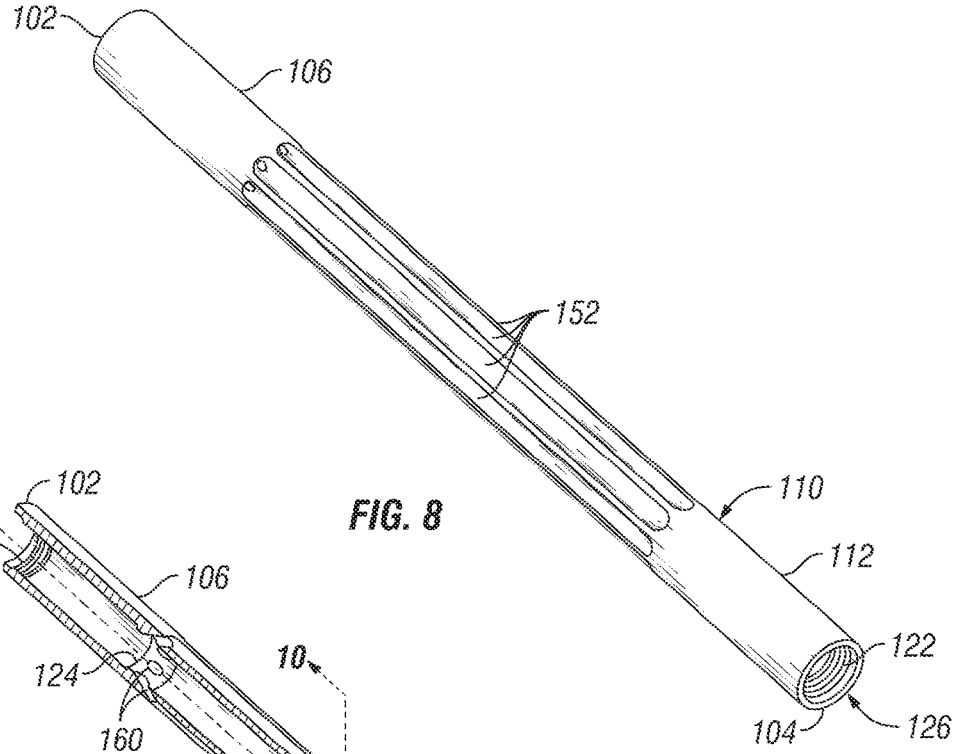
FIG. 8 is a perspective view of a collar with a circumferential arrangement of longitudinal grooves according to an embodiment, which may be used in the drilling system of FIG. 1.
Figure 9:
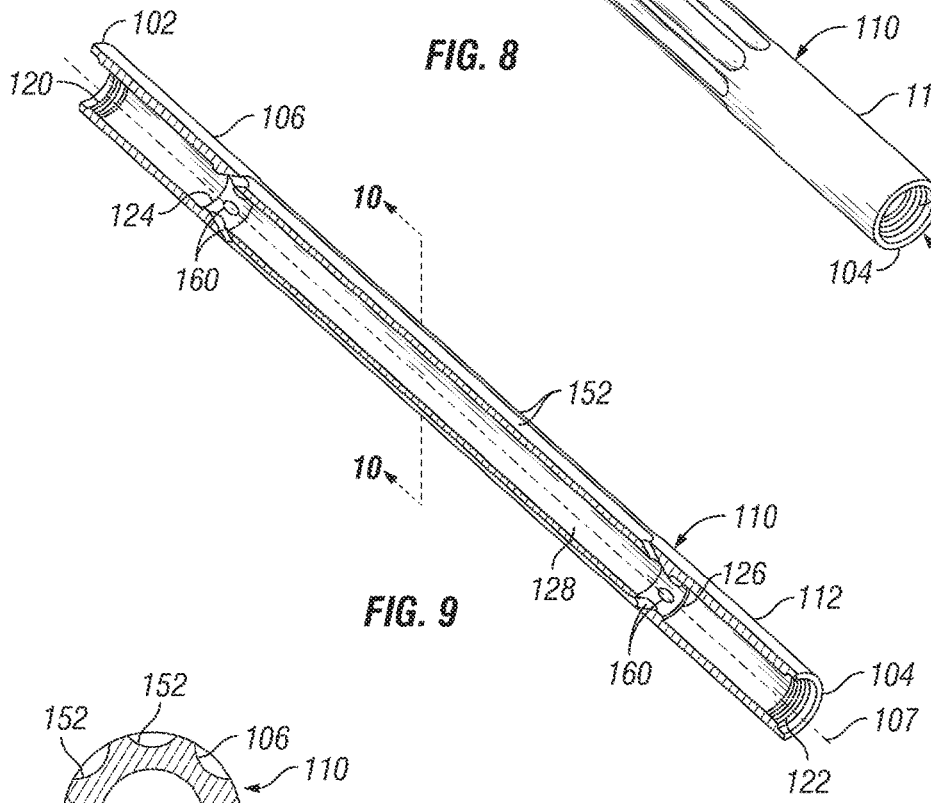
FIG. 9 is a perspective view in axial cross section of the collar of FIG. 8.
Figure 10:
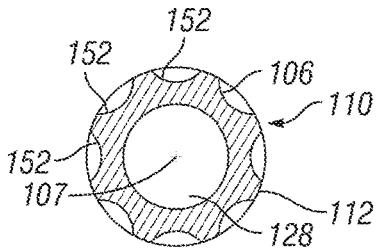
FIG. 10 is a transverse cross section taken along line 10-10 of FIG. 9, showing a medial bore and eight longitudinal grooves.

FIG. 8 is a perspective view of collar 110, according an embodiment, having longitudinal grooves 152 intervaled about the circumference of collar 110. FIGS. 9 and 10 are axial and transverse cross sections, respectively, of collar 110 of FIG. 8. Referring to FIGS. 8-10, collar 110 may have a generally cylindrical body 106 of outer diameter 112 and defining an upper end 102 and a lower end 104. The centerline of collar 110 may define a longitudinal sub axis 107. Collar 110 may be unitary, machined from a single bar for example.

Upper end 102 of collar 110 may include an upper blind bore 124 formed therein, which may be centered at sub axis 107. Similarly, lower end 126 of collar 110 may include a lower blind bore 126 formed therein, which may also be centered at sub axis 107.

Upper and lower ends 102, 104 may have upper and lower connectors 120, 122, respectively. In an embodiment, upper and lower connectors 120, 122 may be integrally formed as part of collar 110. Connectors 120, 122 may be threaded box connectors, for example. However pin connectors, or other types of connectors may be used as appropriate. Connectors 120, 122 may allow sub 100 to be assembled as part of drill string 32 or bottom hole assembly 90 (FIG. 1), for example.

A medial bore 128 may be formed within collar 110, opening into upper blind bore 124 and/or lower blind bore 126. Medial bore 128 may be a blind bore (illustrated in FIGS. 5 and 6), or it may be a through bore that is formed through collar 110 opening between upper and lower blind bores 124, 126, as illustrated in FIG. 9.

An upper angled through bore 160 may be formed between the upper end of each longitudinal groove 152 and upper blind bore 124. Similarly, a lower angled through bore 162 may be formed between the lower end of each longitudinal groove 152 and lower blind bore 126, thereby fluidly coupling upper blind bore 124 with lower blind bore 126 via longitudinal groove 152. As used herein, a through bore refers to hole that is reamed, drilled, milled or otherwise formed so as to break through at least a portion of the work piece. Any suitable angle for upper and lower through bores may be used, up to and including 90 degrees with respect to sub axis 107.

Figure 11:
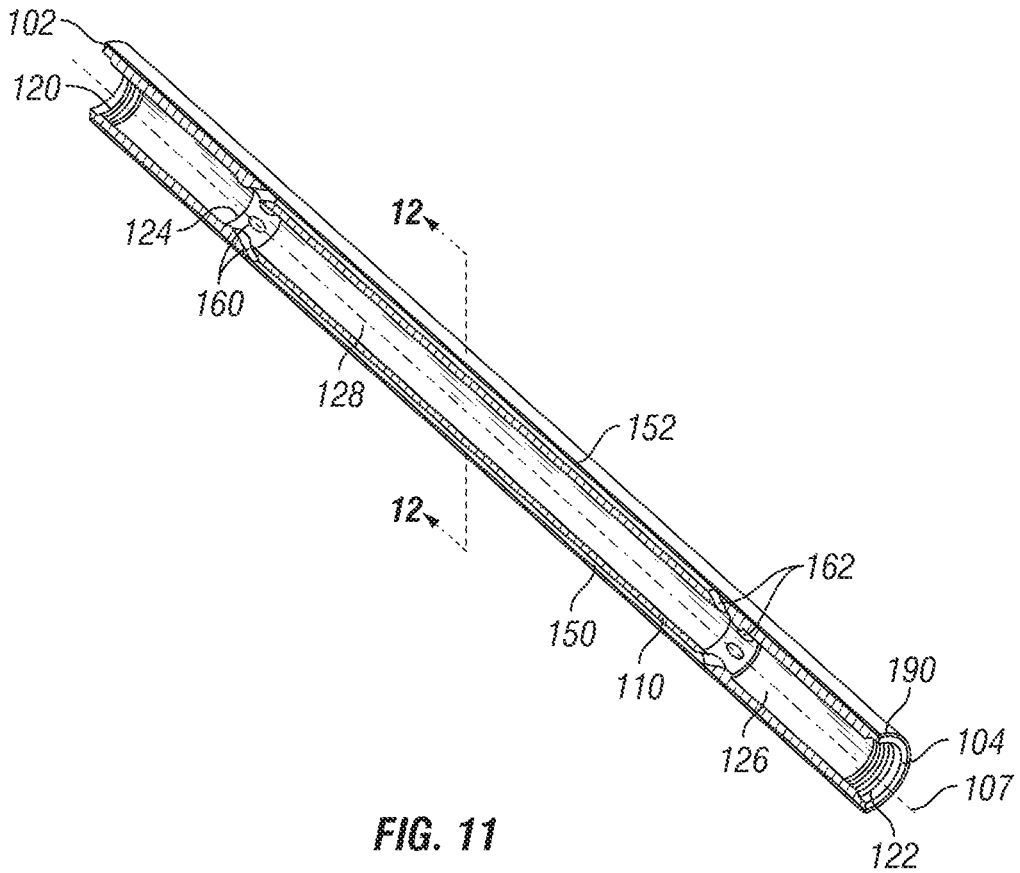
FIG. 11 is a perspective view in axial cross section of a sub according to an embodiment using the collar of FIGS. 8 and 9 with a sleeve-shaped cover.
Figure 12:
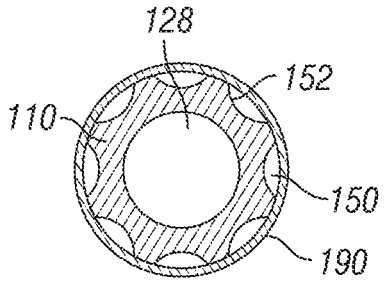
FIG. 12 is a transverse cross section taken along line 12-12 of FIG. 11, showing a medial bore and eight flow channels.

FIG. 11 is a perspective view in axial cross-section of sub 100 according an embodiment, using collar 110 of FIGS. 8-10. FIG. 12 is a transverse cross section of sub 100 of FIG. 11. Flow channels 150 may be formed within sub 100 so as to bypass medial bore 128 by diverting drilling fluid flow to the circumferential extremities while maintaining adequate flow area, thereby maximizing the available diameter of medial bore 128. In an embodiment, one or more flow channels 150 are defined in part by longitudinal grooves 152 formed along the exterior of collar 110 and sleeve-shaped cover 190. Eight such flow channels 150 are illustrated, but any suitable number of flow channels 150 may be provided. Although not expressly illustrated, longitudinal grooves 152 need not be straight. For example, longitudinal grooves 152 may be spiral or helical grooves.

Flow channel cover 190 may be attached to collar 110, thereby preventing fluid flow from exiting sub 100 at longitudinal grooves 152. Although not expressly illustrated, flow channel cover 190 may be attached using fasteners, such as bolts. Gaskets, O-rings, or other seals may be provided between flow channel cover 190 and collar 110 to effect a seal. Flow channel cover 190 may also be both attached to and sealed against collar 110 by welding or brazing, for example. Other suitable attachment and sealing methods may also be used. However, sealing may not be required.

Figure 13:
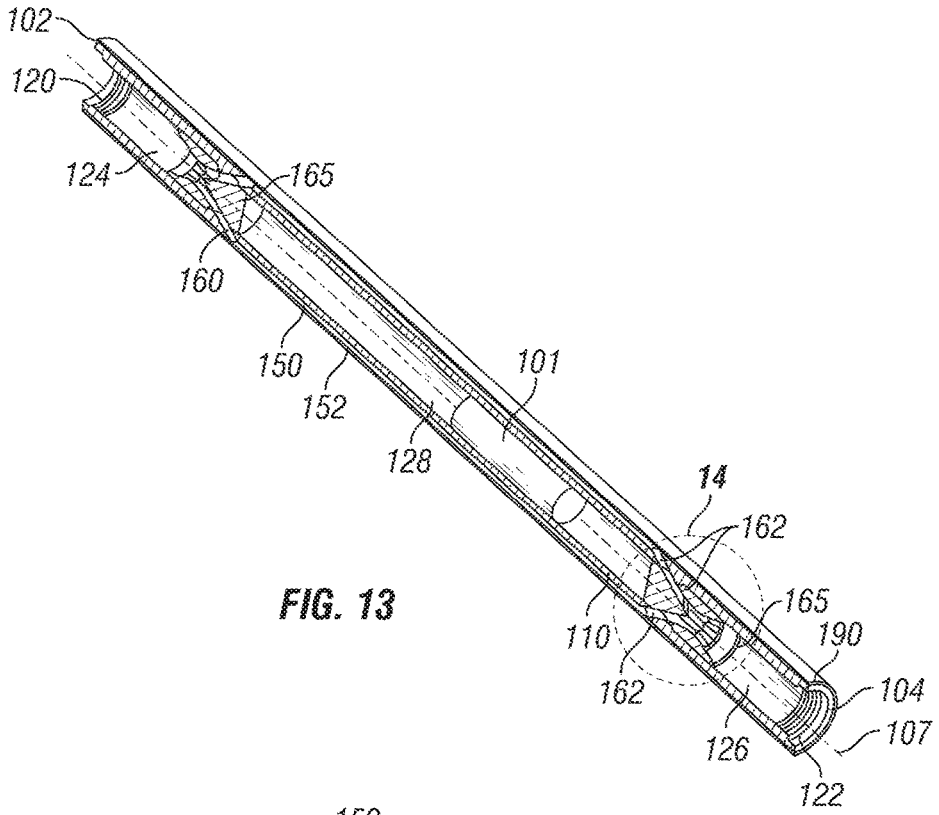
FIG. 13 is a perspective view in axial cross section of the sub of FIG. 11 with flow-diverting plug according to an embodiment.
Figure 14:
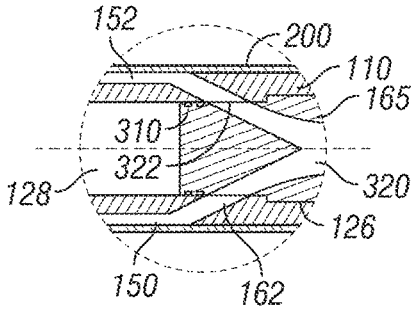
FIG. 14 is a detailed axial cross section of a portion of the sub of FIG. 13 denoted by lines 14-14.
Figure 15:
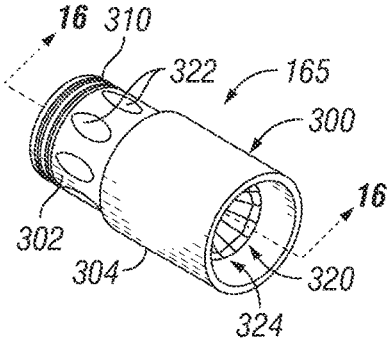
FIG. 15 is an enlarged perspective view of a flow-diverting plug of FIG. 13.
Figure 16:
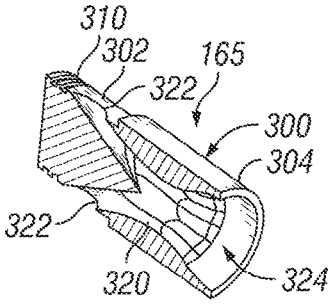
FIG. 16 is an axial cross section taken along lines 16-16 of FIG. 15.

An instrument, tool, detector, circuit and/or other device (not illustrated) may be loaded into medial bore 128, and sealed to avoid effects of hydrostatic pressure. FIGS. 13-16 illustrate an arrangement for sealing a device within medial bore 128 according to an embodiment. FIG. 13 is a perspective view in axial cross section of sub 100 into which each open end of medial bore 128 is sealed from the interior 33 of drill string 32 (FIG. 1) by a flow-diverting plug 165. Depending on the arrangement, the upper end, the lower end, or both, of medial bore 128 may be open to adjacent blind bores 124, 126, respectively. FIG. 14 is an enlarged cross section of a flow-diverting plug 165 installed into the downhole end of medial bore 128 via lower blind bore 126. FIGS. 15 and 16 are a perspective view and a perspective axial cross section, respectively, of flow-diverting plug 165 according to an embodiment.

Referring to FIGS. 13-16, flow-diverting plug 165 may have a generally cylindrical body 300 having a medial portion 302 and a distal portion 304. Medial portion 302 may be dimensioned for being fitted within medial bore 128, and distal portion 302 may be dimensioned for being fitted within either upper blind bore 124 or lower blind bore 126. Medial portion 302 may include an O-ring or similar sealing element 310 for sealing against the inner wall of medial bore 128.

Flow-diverting plug 165 may include a nozzle 320 formed therethrough. Nozzle 320 may be arranged to divert axial flow at distal portion 304 to radial flow at medial portion 302 and vice versa. Nozzle may have a singular opening 324 at a medial end which may be in fluid communication with a number of radial ports 322 at medial portion 302. The number and position of radial ports 322 may be such as to align with angled through bores 160, 162. Nozzle may have a profile designed to minimize pressure drop therethrough.

When flow-diverting plugs 165 are positioned as shown in FIGS. 13-16, medial blind bore 128 forms a cavity into which one or more devices 101 (FIG. 13), such as instruments, detectors, sensors, circuits, and the like, may be inserted.

Figure 17:
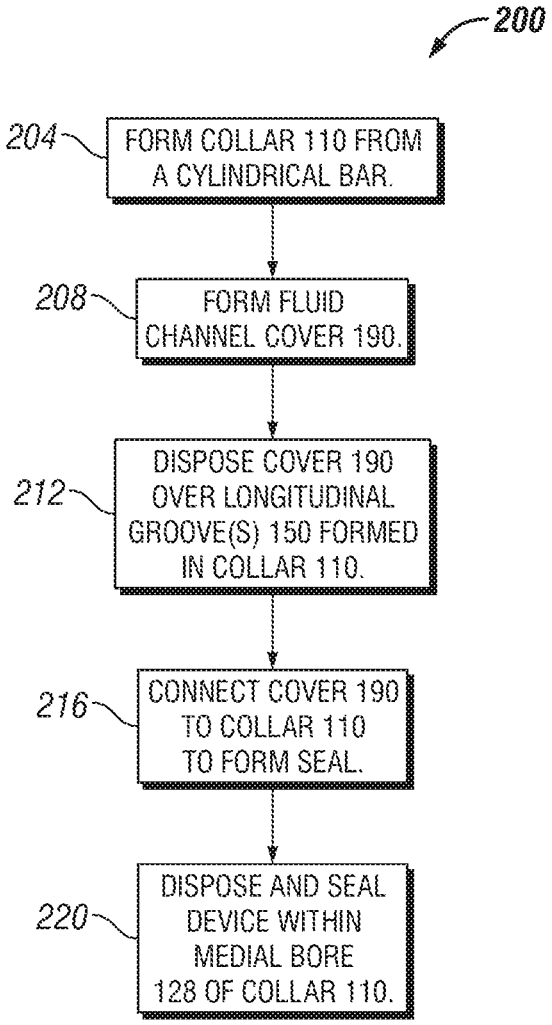
FIG. 17 is a flowchart of a method for manufacturing a downhole tool within a sub according to an embodiment.

FIG. 17 is a flowchart of a method 200 for manufacturing a downhole tool using sub 100 according to an embodiment. As set forth in FIG. 17, with periodic reference to the previous figures, at step 204, collar 110 may be formed, for example as set forth hereinafter with respect to FIG. 18. Collar 110 may include upper and lower connectors 120, 122, upper and lower blind bores 124, 126, a medial bore 128, stabilizer projections 130, longitudinal groove 152 formed along an exterior of the collar, and upper and lower angled through bores 160 162 formed between longitudinal groove 152 and upper and lower blind bores 124, 126, respectively. In an embodiment, collar 110 may be unitary, formed from a solid cylindrical bar using conventional machining and manufacturing processes.

At step 208, flow channel cover 190 may be formed using conventional machining and manufacturing processes. Flow channel cover 190 may be manufactured from the same or similar material as channel 110, which may include steel, stainless steel, or nickel alloys for example. In some embodiments, as illustrated in FIGS. 11 and 12, flow channel cover 190 may be a sleeve that fits about collar 106, which may cover a number of longitudinal grooves 152.

In some embodiments, flow channel cover 190 may have the shape of a strip dimensioned to be received within longitudinal groove 152. In such embodiments, depending on the particular location of longitudinal groove 152 for which flow channel cover 190 is to cover, the outer surface of flow channel cover 190 may be rounded at radius $r_c$ to match outer diameter 112 of collar 110 or at radius $r_p$ to match the curvature of projection 130. A trough 174 may be formed along the inner surface of flow channel cover 190 to provide a portion of fluid flow path 150.

At step 212, flow channel cover 190 is disposed over longitudinal groove 152, and at step 216, collar 110 and flow channel cover 190 are joined together to isolate flow channel (s) 150 from the exterior of collar 110. Flow channel cover 190 may be attached using fasteners, such as bolts. A gasket may be provided between flow channel cover 190 and collar 110, such as at seating surface 170, to effect a seal. Flow channel cover 190 may also be both attached to and sealed against collar 110 by welding or brazing, for example. Other suitable attachment and sealing methods may also be used. However, sealing may not be required.

At step 220, an instrument, tool, detector, circuit, and/or other device 101 (FIG. 13) may be loaded into sub 100 into medial bore 128, and sealed to avoid effects of hydrostatic pressure. Tapered female threads 129 may optionally be provided within medial bore 128 for receiving a threaded plug to seal medial bore 128. However, other sealing methods, such as O-rings or potting, may be used as appropriate.

Figure 18:
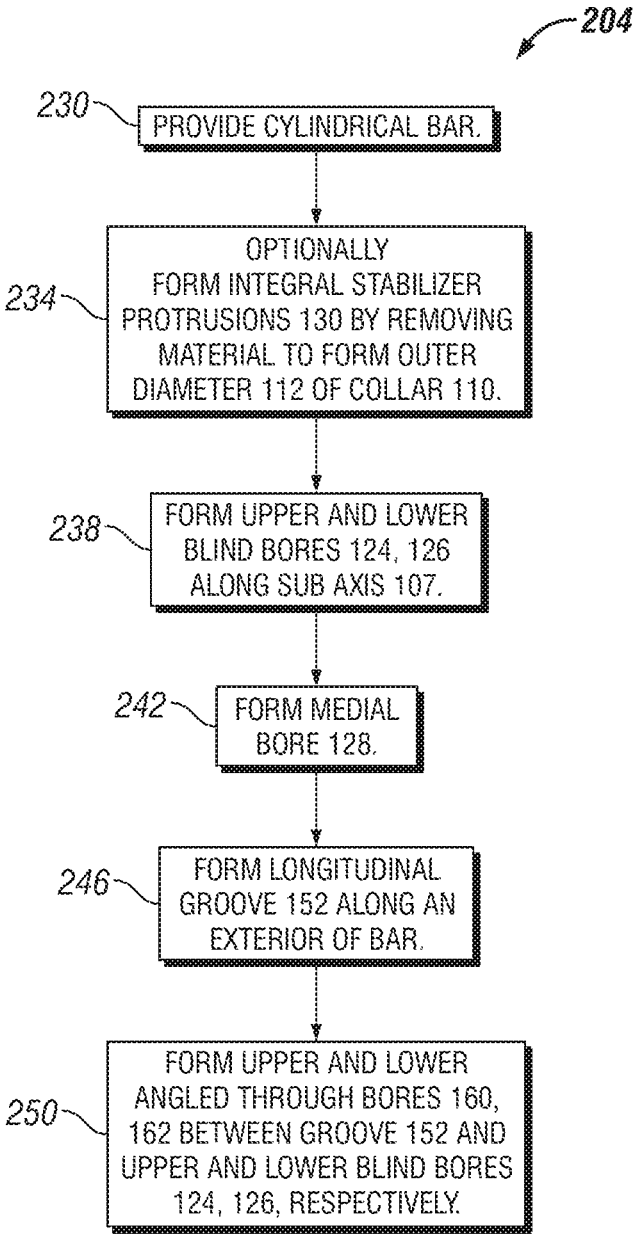
FIG. 18 is a flowchart of a method for manufacturing a collar of the sub of FIG. 17.

FIG. 18 is a flowchart of a method 204, according to an embodiment, for manufacturing a unitary collar 110 by turning, boring, drilling, reaming, milling, grinding and/or other machining and manufacturing techniques. Although FIG. 18 shows steps occurring in a particular sequence, the order of the steps may be varied to facilitate manufacturing.

As set forth in FIG. 18, with periodic reference to the previous figures, at step 230, a solid cylindrical bar may be provided. The bar may be formed of a steel, stainless steel, or nickel alloy, for example, although other suitable materials may be used. The bar may have an outer diameter that is sufficiently large to produce the finished collar 110, with stabilizer protrusions 130 if desired.

At step 234, stabilizer protrusions 130 may optionally be formed by removing material from the cylindrical work piece between and at the ends of stabilizer protrusions 130, thereby defining outer diameter 112 of collar 110. Three or more stabilizer protrusions 130 may be provided and equally spaced about outer diameter 112 to keep sub 100 centered within wellbore 60 (FIG. 1). Stabilizer protrusions 130 may have rounded outer surfaces.

In embodiments using a sleeve-shaped flow cover 190, stabilizer protrusions may optionally be formed on the exterior surface of flow cover 190 at step 208 rather than on collar 110.

Upper and lower blind bores 124, 126 may be formed at upper and lower ends 102, 104 of the work piece. Upper and lower blind bores 124, 126 may be formed centered at sub axis 107 defined by the cylindrical bar. The depths and diameters of upper and lower blind bores 124, 126 may be varied to any suitable dimensions.

At step 242, medial bore 128 may be formed in the work piece from upper end 102 or from lower end 104. Medial bore 128 may be a blind bore or may be through bore opening into both upper and lower blind bores 124, 126.

At step 246, longitudinal groove 152 may be formed along a portion of an outer surface of said bar. In an embodiment, multiple longitudinal grooves 152 may be provided and may be evenly circumferentially spaced about collar 110 or may be located in proximity to one another so as to define a flow channel side 140 of collar 110. Each longitudinal groove 152 may be formed along a stabilizer protrusion 130 and/or along outer diameter 112 of collar 110 between stabilizer protrusions 130, if provided. Each longitudinal groove 152 may be formed as a compound groove, which may include a wider and shallower seating surface 170 and a narrower and deeper trough 172. Seating surface 170 may be flat, and trough 172 may be arcuate, although other profiles may be used as appropriate. Seating surface 170 may provide a receptacle into which a strip-shaped flow channel cover 190 may be positioned and affixed to collar 110. Trough 172 may provide at least a portion of flow channel 150. The dimensions and number of longitudinal grooves 152 may be selected to reduce flow velocity and resultant erosion, increasing reliability and life of sub 100.

At step 250, for each longitudinal groove 152, upper and lower angled through bores 160, 162 may be formed between an upper and lower ends, respectively, of longitudinal groove 152, and upper and lower blind bores 124, 126, respectively. Any suitable angle for upper and lower through bores may be used, up to and including 90 degrees with respect to sub axis 107. The diameter of angles of upper and lower angled through bores 160, 162 may be selected to reduce flow velocity, turbulence, and resultant erosion, increasing reliability and life of sub 100.

In summary, a sub, a downhole tool, and a method for manufacturing a sub have been described. Embodiments of the sub may generally have: A cylindrical unitary collar, the collar defining a longitudinal sub axis; an upper blind bore formed along the sub axis at the upper end of the collar; a lower blind bore formed along the sub axis at the lower end of the collar; a medial bore formed within the collar; a longitudinal first groove formed along an exterior of the collar; a first upper angled through bore formed between an upper end of the first groove and the upper blind bore; a first lower angled through bore formed between a lower end of the first groove and the lower blind bore; and a first cover disposed over the first groove and connected to the collar; whereby the upper blind bore is in fluid communication with the lower blind bore via the first upper angled through bore, the first groove, and the first lower angled through bore. Embodiments of the downhole tool may generally have: A cylindrical unitary collar, the collar defining a longitudinal sub axis; an upper blind bore formed along the sub axis at the upper end of the collar; a lower blind bore formed along the sub axis at the lower end of the collar; a medial bore formed within the collar; a longitudinal first groove formed along an exterior of the collar; a first upper angled through bore formed between an upper end of the first groove and the upper blind bore; a first lower angled through bore formed between a lower end of the first groove and the lower blind bore; a first cover disposed over the first groove and connected to the collar; and a device disposed within the medial bore; wherein the upper blind bore is in fluid communication with the lower blind bore via the first upper angled bore, the first groove, and the first lower angled bore; and the medial bore is fluidly isolated from the upper and lower blind bores. Embodiments of the method may generally include: Forming a collar by providing a cylindrical bar, the bar defining a sub axis, forming an upper blind bore along the sub axis at an upper end of the bar, forming a lower blind bore along the sub axis at a lower end of the bar, forming a medial bore within the bar, forming a longitudinal first groove along an exterior of the bar, forming a first upper angled through bore between an upper end of the first groove and the upper blind bore, and forming a first lower angled through bore between a lower end of the first groove and the lower blind bore; covering the first groove with a first cover; and connecting the first cover to the collar.

Any of the foregoing embodiments may include any one of the following elements or characteristics, alone or in combination with each other: A plurality of stabilizer protrusions intervaled about the exterior; a first of the plurality of stabilizer protrusions is integrally formed as part of the collar; the first groove is formed along the first stabilizer protrusion; the medial bore has an opening formed in one of the upper blind bore and the lower blind bore; a plug dimensioned to be at least partially received within the medial bore for sealing the medial bore from the one of the upper blind bore and the lower blind bore; a nozzle formed in the plug between a medial portion of the plug and a distal portion of the plug, the nozzle having a radial port formed in the medial portion and a longitudinal opening formed in the distal portion; the medial bore is characterized by a centerline that is offset from the sub axis; a longitudinal second groove formed along the exterior in proximity to the first groove; a second upper angled through bore formed between an upper end of the second groove and the upper blind bore; a second lower angled through bore formed between a lower end of the second groove and the lower blind bore; a second cover disposed over the second groove and connected to the collar; a longitudinal third groove formed along the exterior in proximity to the first groove; a third upper angled through bore formed between an upper end of the third groove and the upper blind bore; a third lower angled through bore formed between a lower end of the third groove and the lower blind bore; a third cover disposed over the third groove and connected to the collar; first, second, and third stabilizer protrusions are integrally formed as part of the collar equally distributed about the exterior; the second groove is formed along the second stabilizer protrusion; the third groove is formed along the third stabilizer protrusion; the first, second and third covers are generally strip-shaped; the first cover is generally sleeve-shaped and covers both the first and the second grooves; the first groove is a compound groove including a seating surface and a trough; the first cover is dimensioned to be received at the seating surface; forming a plurality of stabilizer protrusions intervaled about the exterior; forming the first groove along a first of the plurality of stabilizer protrusions; fluidly isolating the medial bore from the upper and lower blind bores; forming the medial bore on a centerline that is offset from the sub axis; forming a longitudinal second groove along the exterior in proximity to the first groove; forming a second upper angled through bore between an upper end of the second groove and the upper blind bore; forming a second lower angled through bore between a lower end of the second groove and the lower blind bore; covering the second groove with a second cover; connecting the second cover to the collar; forming a longitudinal third groove along the exterior in proximity to the first groove; forming a third upper angled through bore between an upper end of the third groove and the upper blind bore; forming a third lower angled through bore between a lower end of the third groove and the lower blind bore; covering the third groove with a third cover; connecting the third cover to the collar; forming first, second, and third stabilizer protrusions about the exterior; forming the second groove along the second stabilizer protrusion; forming the third groove along the third stabilizer protrusion; and covering both the first and second grooves by the first cover.

The Abstract of the disclosure is solely for providing the reader a way to determine quickly from a cursory reading the nature and gist of technical disclosure, and it represents solely one or more embodiments.

While various embodiments have been illustrated in detail, the disclosure is not limited to the embodiments shown. Modifications and adaptations of the above embodiments may occur to those skilled in the art. Such modifications and adaptations are in the spirit and scope of the disclosure.

What is claimed:

1. A sub, comprising:

a collar, said collar defining a longitudinal sub axis;

an upper blind bore formed along said sub axis at said upper end of said collar;

a lower blind bore formed along said sub axis at said lower end of said collar;

a medial bore formed within said collar;

a longitudinal first groove formed along an exterior of said collar;

a first upper angled through bore formed between an upper end of said first groove and said upper blind bore;

a first lower angled through bore formed between a lower end of said first groove and said lower blind bore;

a first cover disposed over said first groove and connected to said collar;

a longitudinal second groove formed along said exterior;

a second upper angled through bore formed between an upper end of said second groove and said upper blind bore;

a second lower angled through bore formed between a lower end of said second groove and said lower blind bore; and a second cover disposed over said second groove and connected to said collar; whereby said upper blind bore is in fluid communication with said lower blind bore via said first and second upper angled through bores, said first and second grooves, and said first and second lower angled through bores.

2. The sub of claim 1 further comprising:

a plurality of stabilizer protrusions intervaled about said exterior.

3. The sub of claim 2 wherein:

a first of said plurality of stabilizer protrusions is integrally formed as part of said collar; and said first groove is formed along said first stabilizer protrusion.

4. The sub of claim 1 further comprising:

an opening formed between said medial bore and at least one of said upper blind bore and said lower blind bore.

5. The sub of claim 4 further comprising:

a plug dimensioned to be at least partially received within said medial bore for sealing said medial bore from said one of said upper blind bore and said lower blind bore.

6. The sub of claim 5 further comprising:

a nozzle formed in said plug between a medial portion of said plug and a distal portion of said plug, said nozzle having a radial port formed in said medial portion and a longitudinal opening formed in said distal portion.

7. The sub of claim 1 wherein:

said medial bore is characterized by a centerline that is offset from said sub axis.

8. The sub of claim 1 further comprising:

a longitudinal third groove formed along said exterior;

a third upper angled through bore formed between an upper end of said third groove and said upper blind bore;

a third lower angled through bore formed between a lower end of said third groove and said lower blind bore; and a third cover disposed over said third groove and connected to said collar.

9. The sub of claim 8 wherein:

first, second, and third stabilizer protrusions are integrally formed as part of said collar equally distributed about said exterior;

said second groove is formed along said second stabilizer protrusion; and said third groove is formed along said third stabilizer protrusion.

10. The sub of claim 8 wherein:

said first, second and third covers are generally strip-shaped.

11. The sub of claim 1 wherein:

said first groove is a compound groove including a seating surface and a trough; and said first cover is dimensioned to be received at said seating surface.

12. A downhole tool, comprising:

a collar, said collar defining a longitudinal sub axis;

an upper blind bore formed along said sub axis at said upper end of said collar;

a lower blind bore formed along said sub axis at said lower end of said collar;

a medial bore formed within an interior of said collar;

a longitudinal first groove formed along an exterior of said collar;

a first upper angled through bore formed between an upper end of said first groove and said upper blind bore;

a first lower angled through bore formed between a lower end of said first groove and said lower blind bore; and a first cover disposed over said first groove and connected to said collar; and a device disposed within said medial bore;

wherein said upper blind bore is in fluid communication with said lower blind bore via said first upper angled bore, said first groove, and said first lower angled bore; and said medial bore is fluidly isolated from both of said upper and lower blind bores.

13. The downhole tool of claim 12 further comprising:

a first stabilizer protrusion integrally formed as part of said collar, said first groove being formed along said first stabilizer protrusion.

14. The downhole tool of claim 12 wherein:

said medial bore is characterized by a centerline that is offset from said sub axis.

15. The downhole tool of claim 12 further comprising:

a longitudinal second groove formed along said exterior in proximity to said first groove;

a second upper angled through bore formed between an upper end of said second groove and said upper blind bore;

a second lower angled through bore formed between a lower end of said second groove and said lower blind bore;

a second cover disposed over said second groove and connected to said collar;

a longitudinal third groove formed along said exterior in proximity to said first groove;

a third upper angled through bore formed between an upper end of said third groove and said upper blind bore;

a third lower angled through bore formed between a lower end of said third groove and said lower blind bore; and a third cover disposed over said third groove and connected to said collar.

16. The downhole tool of claim 15 wherein:

first, second, and third stabilizer protrusions are integrally formed as part of said collar equally distributed about said exterior;

said second groove is formed along said second stabilizer protrusion; and said third groove is formed along said third stabilizer protrusion.

17. The downhole tool of claim 12 further comprising:

a longitudinal second groove formed along said exterior in proximity to said first groove;

a second upper angled through bore formed between an upper end of said second groove and said upper blind bore; and a second lower angled through bore formed between a lower end of said second groove and said lower blind bore; wherein said first cover is generally sleeve-shaped and covers both said first and said second grooves.

18. The downhole tool of claim 12 further comprising:

a plug at least partially received within the medial bore to fluidly isolate the medial bore from one of the upper blind bore and the lower blind bore.

19. The downhole tool of claim 18 further comprising:

an opening formed between said medial bore and the other of said upper blind bore and said lower blind bore; and a seal disposed within said opening to fluidly isolate the medial bore from the other of the upper blind bore and the lower blind bore.

20. A method for manufacturing a sub, comprising:

forming a collar by providing a bar, said bar defining a sub axis, forming an upper blind bore along said sub axis at an upper end of said bar, forming a lower blind bore along said sub axis at a lower end of said bar, forming a medial bore within said bar, forming a longitudinal first groove along an exterior of said bar, forming a first upper angled through bore between an upper end of said first groove and said upper blind bore, forming a first lower angled through bore between a lower end of said first groove and said lower blind bore, forming a longitudinal second groove along said exterior, forming a second upper angled through bore between an upper end of said second groove and said upper blind bore, and forming a second lower angled through bore between a lower end of said second groove and said lower blind bore;

covering said first groove with a first cover;

connecting said first cover to said collar;

covering said second groove with a second cover; and connecting said second cover to said collar.

21. The method of claim 20 further comprising:

forming a plurality of stabilizer protrusions intervaled about said exterior.

22. The method of claim 21 further comprising:

forming said first groove along a first of said plurality of stabilizer protrusions.

23. The method of claim 20 further comprising:

fluidly isolating said medial bore from said upper and lower blind bores.

24. The method of claim 20 further comprising:

forming said medial bore on a centerline that is offset from said sub axis.

25. The method of claim 20 further comprising:

forming a longitudinal third groove along said exterior;

forming a third upper angled through bore between an upper end of said third groove and said upper blind bore;

forming a third lower angled through bore between a lower end of said third groove and said lower blind bore;

covering said third groove with a third cover; and connecting said third cover to said collar.

26. The method of claim 25 further comprising:

forming first, second, and third stabilizer protrusions about said exterior;

forming said second groove along said second stabilizer protrusion; and forming said third groove along said third stabilizer protrusion.

* * * * *